United States Patent [19]

Mizzi

[11] 3,995,779

[45] Dec. 7, 1976

[54] AEROSOL CONTAINER

[75] Inventor: John V. Mizzi, Poughkeepsie, N.Y.

[73] Assignee: Lawrence Peska Associates, Inc., New York, N.Y. ; a part interest

[22] Filed: Mar. 17, 1976

[21] Appl. No.: 667,710

[52] U.S. Cl. ..... 222/401

[51] Int. Cl.[2] ..... B65D 83/14

[58] Field of Search ..... 222/255, 263, 401, 402, 222/162, 196.1, 196

[56] References Cited

UNITED STATES PATENTS

| | | | |
|---|---|---|---|
| 2,645,184 | 7/1953 | Lowe | 222/162 X |
| 2,982,443 | 5/1961 | Ellis | 222/401 X |

*Primary Examiner*—Stanley H. Tollberg
*Assistant Examiner*—Hadd S. Lane
*Attorney, Agent, or Firm*—Joel Halpern

[57] ABSTRACT

An aerosol container includes a housing and a manually operable discharge valve mounted thereon for the dispensing of a liquid from the container. A reservoir for the liquid to be dispensed is mounted within the container and a chamber adapted to contain a supply of pressurized air is also mounted within the container. An air pump is mounted within the housing adapted to develop a supply of pressurized air upon oscillatory motion of the container by shaking. The container is so constructed as to provide for the withdrawal of liquid from the reservoir and for the discharge of the liquid thus withdrawn from the discharge valve under the influence of the pressurized air.

8 Claims, 5 Drawing Figures

FIG.3
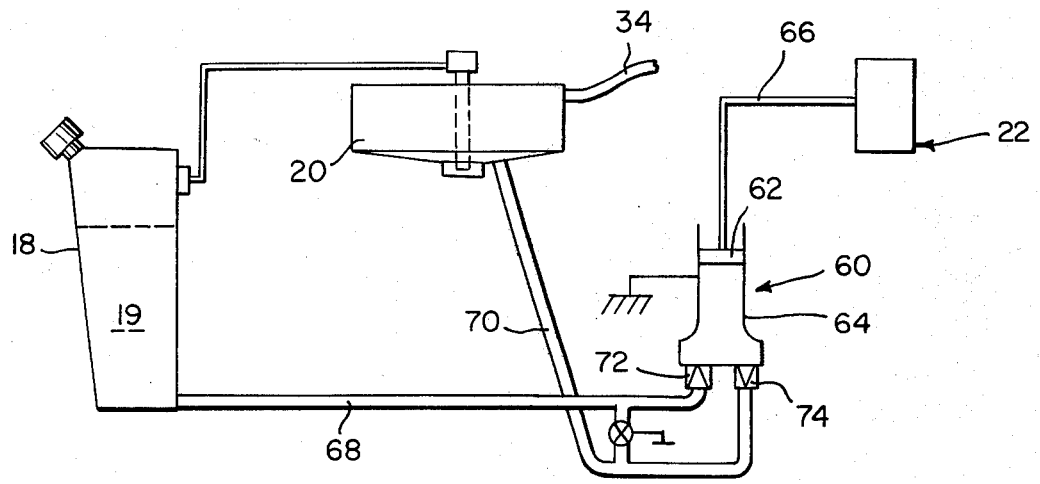
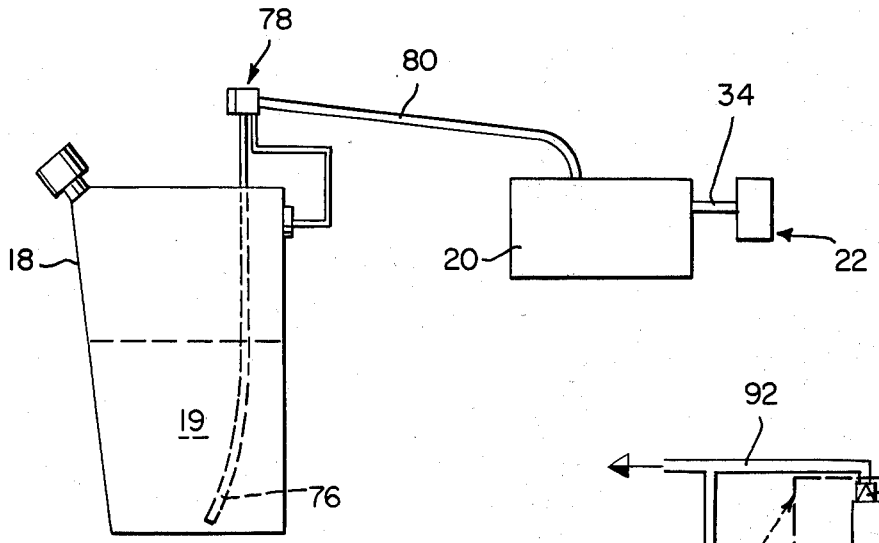
FIG.4
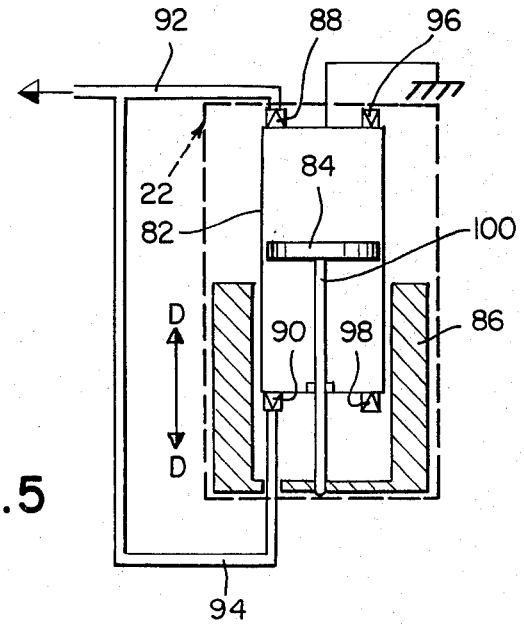
FIG.5

AEROSOL CONTAINER

BACKGROUND OF THE INVENTION

The present invention relates to aerosol containers and more particularly to such aerosol containers which do not require a propellant material maintained continuously in pessurized state therewithin.

Aerosol containers have been in widespread use as liquid dispensing devices. The conventional aerosol container utilizes a propellant material such as carbon dioxide or one of the fluorocarbons to pressure the liquid from the container. In this manner insecticides, deodorants, medicines and other liquids may be dispensed. However, it is known that the propellant fluid frequently constitutes a source of environmental pollution and sometimes the aerosol container represents a hazard when disposed of since the propellant material may be explosive or at the very least inflammable. Further, the conventional aerosol container is discarded once the supply of liquid dispersant is exhausted or when the supply of propellant material has been used to the extent that there is no longer sufficient pressure within the container to discharge the liquid as intended.

A spray device has been available heretofore which does not require the use of a pressurizing gas or other foreign propellant. Thus, the aforesaid disadvantages have to some extent been ameliorated. Such a device is disclosed in U.S. Pat. No. 3,777,945 issued Dec. 11, 1973 to Takamitsu Nozawa et al. The device disclosed in the patent employs a pair of slidable pistons, one of which is spring biased, to withdraw liquid from the bottom of the container and to discharge the liquid through a discharge valve at the top of the container. The device requires a rotatable cap which, by means of a ball and groove arrangement, cyclically reciprocates the lower piston to withdraw liquid from the bottom of the container and to force the liquid into an upper pressurizing chamber from which the liquid is forced to the discharge valve by the upper spring-biased piston. The construction is relatively complex, requires close tolerances and depends upon the force of a spring to develop and maintain pumping pressure to the discharge nozzle. Such a construction thus presents various points of vulnerability and would be relatively expensive to produce.

SUMMARY OF THE INVENTION

It is one object of the invention to provide an aerosol container which does not require the continued presence of a propellant material for discharge of the liquid to be dispensed.

It is another object of the invention to provide an aerosol container which requires refilling only of the liquid to be dispensed and is thus reusable.

It is another object of the invention to provide an aerosol container in which development of a pressurized air supply for discharge of the liquid to be dispensed is developed through shaking of the container thereby eliminating the need for the storage of a pressurized propellant therein.

Other objects and advantages of the invention will become readily apparent from the following description of the invention.

According to the present invention there is provided an aerosol container comprising in combination: a housing, a manually operable discharge valve carried by the housing and adapted to selectively dispense a pressurized liquid therefrom; a reservoir mounted within the housing for the storage of the liquid to be dispensed, a chamber mounted within the housing adapted to contain a supply of pressurized air, air pump means mounted within said housing and adapted to develop a supply of pressurized air upon oscillatory motion of the container; conduit means for conveying pressurized air from the air pump means to the chamber; and means for withdrawing liquid from the reservoir and conveying same to the discharge valve and for dispensing same from the discharge valve under the influence of the pressurized air in the chamber.

BRIEF DESCRIPTION OF THE DRAWINGS

In order that the invention may be more fully comprehended it will now be described, by way of example, with reference to the accompanying drawings in which:

FIG. 3 is a schematic view illustrating one constructional arrangement for conveying the liquid to be dispensed from the reservoir to the discharge valve and for developing a supply of pressurized air;

FIG. 4 is a schematic view illustrating another constructional arrangement for conveying the liquid to be dispensed from the reservoir to the discharge valve; and FIG. 5 is a side elevational view of an aerosol container in accordance with the invention, partly in cross-section, showing another form of air pump for development of the pressurized air supply.

DETAILED DESCRIPTION OF THE INVENTION

Figure 1:
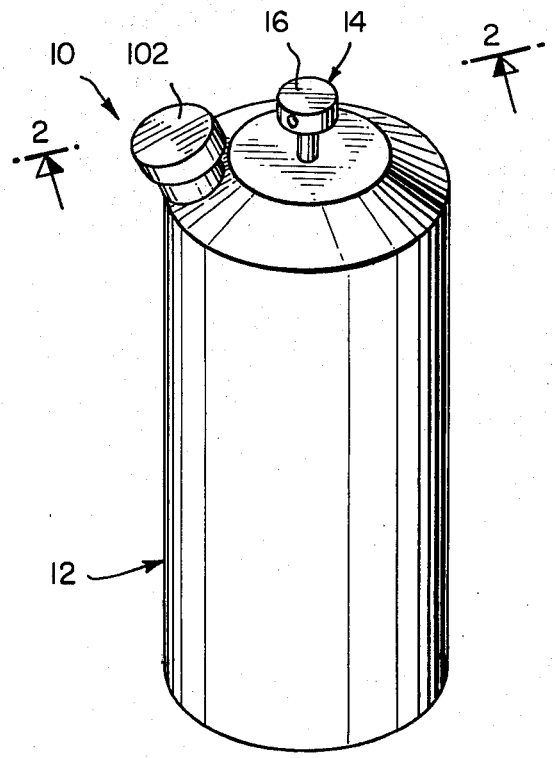
FIG. 1 is a perspective view of an aerosol container embodying the features of the invention.

Referring to the accompanying drawings is shown generally, as indicated by reference numeral 10, an aerosol container. The container includes a housing 12 upon which there is mounted a manually operable discharge valve 14. The discharge valve is of known construction and, therefore, will not be described in detail herein. A push button 16 surmounts the valve and is depressed manually to thereby register a discharge opening in the valve with a discharge conduit in the container for dispensing of the liquid. A spring generally is provided for biasing of the valve button in the closed position. It will be understood, however, that the exact valve construction is not critical to this invention, it merely being necessary that it be manually operable to provide a discharge outlet in communication with the outlet of the container to thus enable the discharge of the pressurized liquid to be dispensed.

Figure 2:
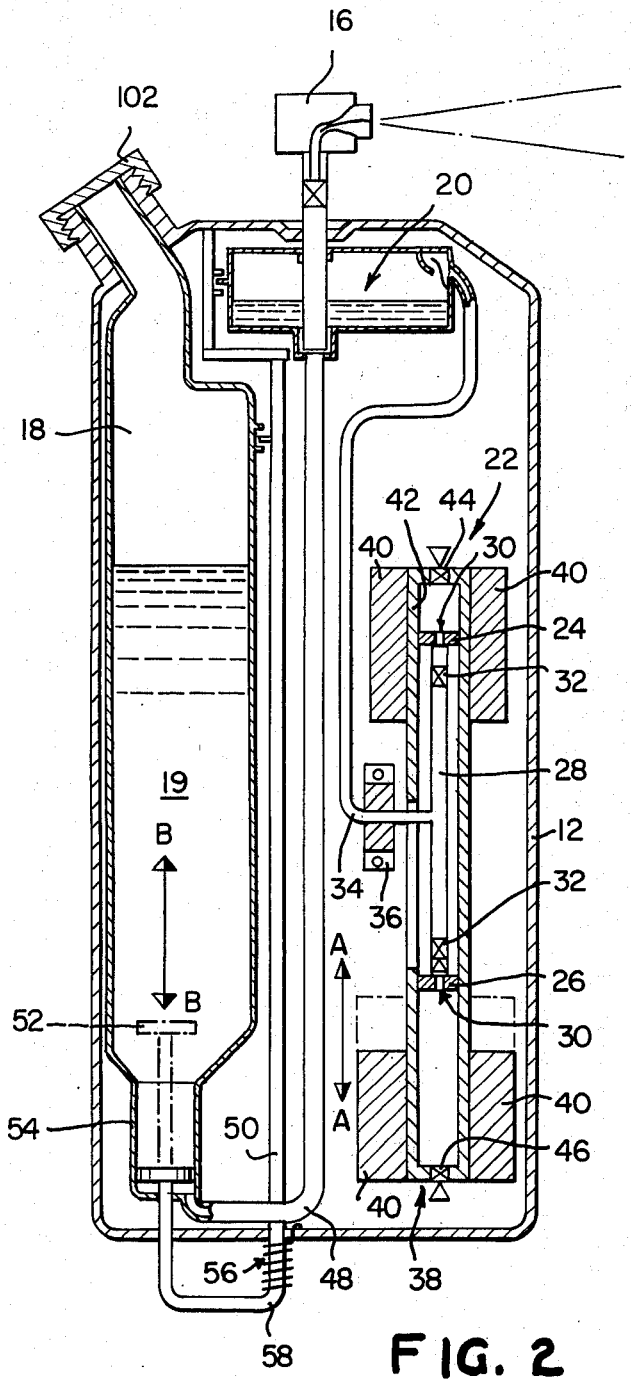
FIG. 2 is a side elevational view, partly in cross-section, of the aerosol container shown in FIG. 1 taken along line 2—2 thereof.

As shown more clearly in FIG. 2, a reservoir 18 is mounted within the housing and is adapted to contain a supply of the liquid 19 which is to be dispensed. Also mounted within the housing is a chamber 20 for pressurized air and for liquid withdrawn from the reservoir for discharge from valve 14 under the influence of the air pressure. In the ensuing description of the invention it will be seen, with particular reference to the arrangement shown in FIG. 4, that the liquid need not be conveyed to chamber 20 prior to being discharged from the container.

The housing also provides an enclosure and frame for an air pump mechanism 22 within which the supply of pressurized air is developed for subsequent use in the pressuring of the liquid from the container when valve 14 is manipulated to its operative discharge position. In the embodiment illustrated in FIG. 2 the air pump includes a pair of pistons 24, 26 which are fixedly mounted at the opposed ends of a hollow connecting conduit or rod 28. Each of the pistons is provided with an opening 30 for the admission of pressurized air therethrough. A check valve 32 is mounted adjacent each end of the connecting conduit inwardly of the piston and is adapted to permit the flow of pressurized air through the connecting conduit and into high pressure line 34 which communicates at one end thereof with an intermediate section of conduit 28 and at the other end with chamber 20 preferably at a location above the normal level of liquid within such chamber. The high pressure conduit or line 34 is rigidly mounted within the housing such as by means of a flange or bracket 36 which itself is secured to the inner surface of the housing. A cylinder assembly 38 is mounted within the housing for reciprocable movement therewithin. The cylinder assembly is provided with weighted portions 40 positioned at the respective ends thereof. Such weights assist in the development of momentum when the container is oscillated in a substantially vertical direction as by shaking of the container. Such momentum serves to propel the cylinder assembly in a reciprocatory motion as shown by arrows A in FIG. 2. The cylinder assembly includes cylinder section 2 which is of sufficient length to enclose both of pistons 24, 26 during such reciprocation. In this manner air is alternately drawn into the respective ends of the cylinder which are closed except for check valves 44, 46 which are adapted to admit air into the cylinder when the cylinder assembly is reciprocating in a direction such that the associated end wall thereof is moving away from the adjacent portion. When the cylinder assembly is travelling in the reverse direction air is not permitted to exit from the cylinder.

A conduit 48 is connected adjacent the lower portion of reservoir 18 and extends to chamber 20 so as to enable the transfer of liquid from the reservoir to the chamber.

An actuator rod 50 is mounted within the housing and is adapted to be shifted in the directions indicated by arrows B in order to force liquid from the reservoir to the chamber. For this purpose one end of the actuator rod extends into the reservoir and carries a plunger 52 thereon which is cooperable with the lowermost inner walls 54 of the reservoir to thereby form a variable volume pump. In FIG. 2 the plunger is shown in phantom lines in its uppermost position. Spring 56 is provided encircling a portion 58 of the actuator rod which protrudes from the bottom of the container. Thus, the actuator rod is biased so as to urge plunger 52 towards its lowermost position. By this arrangement a predetermined quantity of liquid can be pumped from the reservoir to the chamber 20 upon complete shifting of the actuator rod under the influence of spring 56. This offers a convenient feature since when the container is stored on a shelf, the actuator rod is shifted upwardly against the force of the spring and liquid gravitates behind the plunger within the reservoir as defined by inner walls 54. When the container is removed from the shelf, the spring shifts the plunger and actuator rod downwardly to thereby deliver a quantity of the liquid to the chamber for discharge upon actuation the discharge valve.

Referring to FIG. 3 there is shown an arrangement by which a liquid pump 60 is driven concomitantly with the air pump 22. The liquids pump is mounted within the housing and is given a piston 62 which is reciprocable within a closed cylinder 64. A drive rod 66 operatively connects the piston with the reciprocable element of the air pump. Thus, where a weighted cylinder assembly as shown in FIG. 2 is provided the drive rod 66 connects piston 62 to the reciprocable cylinder assembly. However, when a stationary cylinder and reciprocable piston is employed as the air pump 22 the drive rod connects the piston 62 with the reciprocable piston of the air pump. Separate conduits 68, 70 connect the cylinder of the liquids pump respectively to the reservoir and air pressure chamber 20. Check valves 72, 74 are interposed in the conduits so as to permit the admission of liquid to the cylinder from the reservoir and the discharge of pressurized liquid from the liquids pump to the pressure chamber 20. Thus, reciprocation of the piston 62 of the liquids pump alternately serves to introduce liquid into the pump from the reservoir and to pump liquid from the pump to the pressure chamber 20.

Referring to FIG. 4 it will be seen that the liquid from the reservoir is not transferred to air pressure chamber 20 prior to discharge from the container. In accordance with this embodiment a dip tube 76 is connected adjacent its upper end to the discharge valve 14 via a venturi tube 78 shown schematically. It will be appreciated that the design of the venturi tube is such as to aspirate desired quantities of liquid from the reservior for transfer to the discharge valve 14. The lower end of the dip tube extends into the reservoir and terminates adjacent the bottom thereof. A conduit 80 extends between the air pressure chamber and the discharge valve and is adpated to direct a stream of pressurized air through the venturi in order to aspirate liquid from the reservoir.

FIG. 5 of the drawings shows a modified form of air pump utilizable with the aerosol container. In accordance with this embodiment a cylinder 82 is fixedly mounted within the housing and is closed at both ends thereof. A piston 84 is mounted for reciprocation within the cylinder and is provided with weighted portions 86 which serve a function similar to that of weighted portions 40 described above in relation to cylinder assembly 38 shown in FIG. 2. Check valves 88, 90 are provided in the opposed ends of the cylinder or in conduits 92, 94 which extend from such ends of the cylinder to pressure chamber 20. Check valves 96, 98 are also provided in the respective ends of the cylinder to permit the admission of air to the opposed ends of the cylinder on alternate strokes of the piston. Thus as the piston moves upwardly in the direction of arrow C pressurized air is forced past check valve 88 into conduit 92 and is conveyed to the pressure chamber. During the downward stroke in the direction of arrow D pressurized air is forced through check valve 90 and conduit 94 into chamber 20.

It will of course be understood that the necessary seals such as O rings are provided around the opening in cylinder 82 through which piston rod 100 extends and in the opening at the bottom of the reservoir through which portion 58 of the actuator rod extends and in such other apertures as are provided to permit reciprocation or other movement of one of the elements of the assembly. It will also be understood that suitable venting means are provided for the reservoir, chamber and liquids pump.

A refill cap 102 may be threadedly connected to the housing and may be removed when desired in order to replenish the liquid supply within the reservoir 18.

It is contemplated that a maximum air pressure of approximately 10 psig can be developed air pressure chamber 20, the quantity of liquid to be dispensed per application, the volume of the pressure chamber and the volume of liquid to be dispensed per application being determinable by the specific dimensions selected for the reservoir, conduits and the capacity of the air pump.

It will also be appreciated that various changes may bemade in the illustrated embodiments without departing from the spirit of the invention or the scope of the claims herein.

I claim:

1. An aerosol container comprising in combination:

a housing;

a manually operable discharge valve carried by said housing and adapted to selectively dispense a pressurized liquid therefrom;

a reservoir mounted within said housing for the storage of the liquid to be dispensed;

a chamber mounted within said housing adapted to contain a supply of pressurized air;

air pump means mounted within said housing and adapted to develop a supply of pressurized air upon oscillatory motion of the container;

conduit means for conveying pressurized air from said air pump means to said chamber;

and means for withdrawing liquid from said reservoir and conveying same to said discharge valve and for dispensing same from said discharge valve under the influence of the pressurized air in said chamber.

2. An aerosol container according to claim 1, including conduit means connecting said reservoir and said chamber and means for forcing liquid from said reservoir to said chamber through said conduit means.

3. An aerosol container according to claim 2, wherein said liquid forcing means includes an actuator rod mounted for reciprocation in said housing, one end of said actuator rod extending into the lower portion of said reservoir and carrying plunger means thereon cooperable with the inner walls of said reservoir to thereby form a variable volume pump for the forcing of liquid from said reservoir to said chamber upon alternate reciprocatory strokes of said rod, spring means being operatively connected to said actuator rod to bias said rod in one direction.

4. An aerosol container according to claim 2, wherein a liquids pump is mounted within said housing having a piston reciprocable within a cylinder of said pump, separate conduit means being provided to respectively connect said pump with said reservoir and chamber, a drive rod operatively connecting the piston of said liquids pump with said air pump means, and check valve means mounted in said separate conduit means whereby reciprocation of said liquids pump piston by said drive rod in one direction draws liquid into the cylinder from said reservoir and reciprocation of said liquids pump piston in the other direction pumps liquid from the cylinder to said chamber.

5. An aerosol container according to claim 1, wherein said means for withdrawing liquid from said reservoir and for conveying same to said discharge valve includes a dip tube connected adjacent to one end thereof to said discharge valve and having the other end extending into said reservoir to terminate in the lower portion thereof, conduit means extending between said chamber and said discharge valve, and venturi means connecting said dip tube and the conduit means connecting said chamber and discharge valve whereby liquid is aspirated from said reservoir for dispensing by said discharge valve.

6. An aerosol container according to claim 1, wherein said air pump means includes a cylinder and at least one piston mounted for relative movement therebetween by the oscillatory movement of the container.

7. An aerosol container according to claim 6, including a pair of pistons mounted fixedly at the ends of a connecting conduit, said connecting conduit being fixedly mounted within said housing, each of said pistons having an opening therein, a check valve interposed at each end of said connecting conduit adjacent the opening in the respective pistons adapted to cyclically admit pressurized air through said openings into said connecting conduit, said conduit means for conveying pressurized air from said air pump to said chamber being connected at one end thereof to an intermediate section of said connecting conduit and a weighted cylinder assembly reciprocably carried within said housing and including a cylinder section of sufficient length to enclose said pistons during the reciprocable movement thereof, a check valve being mounted in the respective outer end walls of said cylinder section adapted to admit air to each end of said cylinder upon reciprocation of the said end wall away from the adjacent piston positioned therewithin and to prevent the discharge of pressurized air therethrough when said end wall is reciprocating in a direction towards the piston in the cylinder, whereby a continuous supply of pressurized air is forced through said connecting conduit to said chamber during reciprocation of said cylinder assembly.

8. An aerosol container according to claim 6, including a closed cylinder fixedly secured within said housing and a weighted piston mounted within said cylinder for reciprocable movement, said conduit means for conveying pressurized air from said air pump to said chamber including first and second conduits connected respectively between the ends of said cylinder and said chamber, first outlet check valves being interposed in each of said first and second conduits and second inlet check valves being mounted in the respective ends of said cylinder whereby pressurized air is continuously forced through said first and second conduits to said chamber from said cylinder during reciprocation of said piston and air is admitted cyclically to each end of said cylinder through said first and second inlet check valves.

* * * * *